US005533537A

United States Patent [19]

Mourad

[11] Patent Number: 5,533,537

[45] Date of Patent: Jul. 9, 1996

[54] HAIR COLORING APPLICATOR

[76] Inventor: Esther Mourad, 250 S. President St., Apt. 303, Baltimore, Md. 21202

[21] Appl. No.: 453,650

[22] Filed: May 30, 1995

[51] Int. Cl.[6] ..... A45D 24/00

[52] U.S. Cl. ..... 132/148; 132/116; 132/149; 132/113

[58] Field of Search ..... 132/125, 148, 132/149, 112, 113, 114, 115, 116, 212, 272, 271, 232

[56] References Cited

U.S. PATENT DOCUMENTS

| | | | |
|---|---|---|---|
| 246,260 | 11/1877 | Forrester . | |
| 290,065 | 6/1887 | Battaglia . | |
| 2,249,267 | 7/1941 | Berry | 132/148 |
| 2,334,737 | 11/1943 | Woodruff | 132/149 |
| 2,528,108 | 10/1950 | Bly et al. | 132/116 |
| 2,785,688 | 3/1957 | Chester | 132/148 |
| 3,368,569 | 2/1968 | Lawrence | 132/116 |
| 3,429,642 | 2/1969 | Underwood | 132/116 |
| 3,640,288 | 2/1972 | Spanel . | |
| 3,861,407 | 1/1975 | Gabriele . | |
| 5,107,869 | 4/1992 | Henry | 132/148 |
| 5,195,545 | 3/1993 | Thibodeaux . | |
| 5,301,695 | 12/1994 | Wong . | |

*Primary Examiner*—Nicholas D. Lucchesi
*Assistant Examiner*—Pedro Philogene
*Attorney, Agent, or Firm*—Robert E. Bushnell

[57] ABSTRACT

A hair coloring applicator formed as a unitary, monolithic structure having an applicator portion, an intermediate portion and a pick portion is provided. The applicator portion is provided with a spoon for scooping hair coloring materials and a rounded head for spreading the material into the hair. One side of the applicator portion is provided with a serrated edge with ridges for lightly scratching the hair shaft to enable even distribution of the hair coloring materials. The other side of the applicator portion is thicker and provides a comb having a plurality of teeth which aid in spreading the materials and detangling the hair. The intermediate portion connects to one end of the applicator portion and includes a handle and guard portions on both sides of the handle. The pick portion extends in a tapered manner from one end of the intermediate portion and provides a mechanism for the user to section and weave hair during a hair coloring procedure.

21 Claims, 3 Drawing Sheets

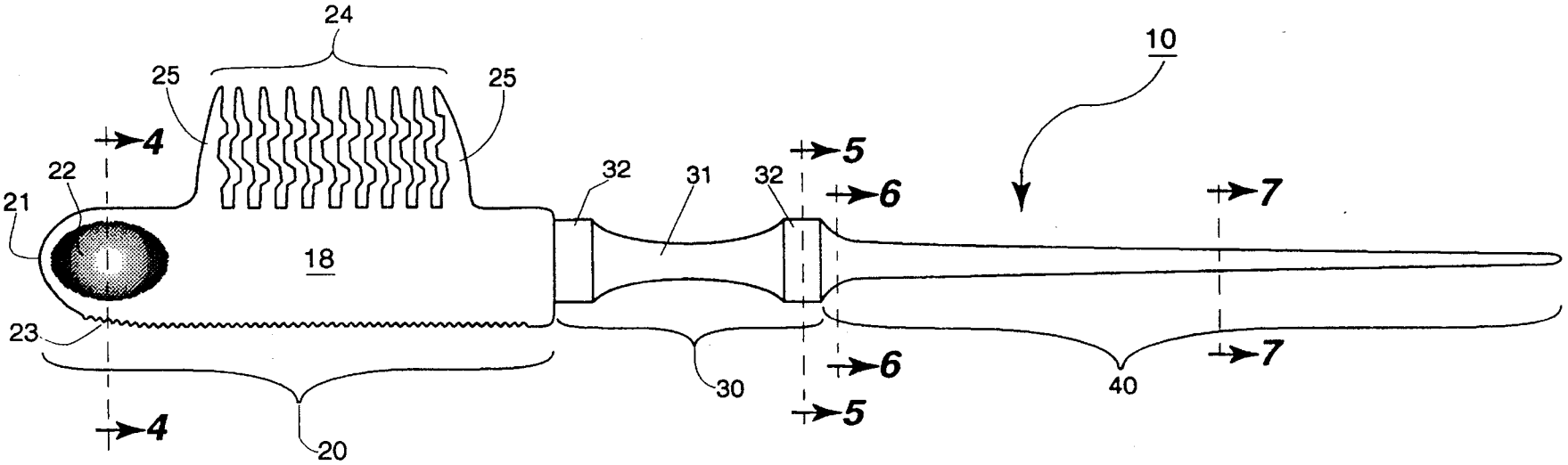
FIG. 1
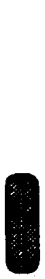
FIG. 5
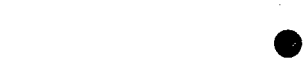
FIG. 6
FIG. 7
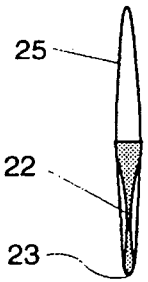
FIG. 4

HAIR COLORING APPLICATOR

CROSS-REFERENCE TO RELATED DISCLOSURE

This application makes reference to, and claims all benefits accruing from an invention disclosure document for a Hair Coloring Applicator filed in the United States Patent and Trademark Office on 4 May 1995 and assigned Ser. No. 375,648.

BACKGROUND OF THE INVENTION

The present invention relates to an improved applicator for coloring growing hair of human beings, and more particularly, to a hair coloring applicator which advantageously provides several hair styling tools in a single unitary structure.

Traditionally, hair coloring of human beings has been performed in a beauty salon by first using a comb to separate strands of hair and then using some type of dispenser or applicator to apply a hair coloring or dye material to the hair. Next, a small brush with a row of hard bristles is used to spread the material over the exposed roots of the hair. Accordingly, in order to effectively perform a hair coloring process, it is necessary for the hair technician to utilize several different tools. This can become inconvenient for the technician since the technician must repeated switch tools manually. Furthermore, the switching of tools lengthens the duration of the process, thereby delaying both the technician and the client. Therefore, there has been a need in the art to provide a single device by which the entire hair coloring process can be quickly and effectively performed.

One such device is disclosed in U.S. Pat. No. 5,301,695 entitled Brush And Method For Hair Treatment Using Bristle Arrays Of Different Densities And Materials issued to Wong on 12 Apr. 1994. In Wong '695, a unitary device for performing a hair coloring process is ostensibly provided. The disclosed device has a head with a handle and three arrays of bristles extending therefrom. The device purportedly provides a technician with the ability to simultaneously comb hair on one side of a hair partition, apply a coloring solution to the partition, spread the solution, and repartition the hair for a subsequent application of the solution. While conventional art such as Wong '695 has merit in its own right, I believe that an improved device can be produced. Moreover, I have discovered that devices that position a brush in this manner are messy and not only are susceptible to fouling as the coloring solution towels from the bristles to the handle and contacts the fingers of the technician. Furthermore, the bristles of this type of brush can become easily clogged with excessive quantities of the coloring solution. I have found that these deficiencies can result in the coloring solution being spread to unintended hairs within a part during application of the coloring solution.

SUMMARY OF THE INVENTION

Accordingly, it is an object of the present invention to provide an improved hair coloring applicator.

It is another object to provide a hair coloring applicator that incorporates several hair styling tools into a single unitary structure.

It is still another object to provide a hair coloring applicator that will allow a user to accurately control the exact amount of chemical being applied to hair on the head of a human being.

It is yet another object to provide a hair coloring applicator that prevents the occurrence of spotting and bleeding in a hair treatment procedure.

It is still yet another object to provide a hair coloring applicator that enables human hair to absorb chemicals in a faster and more even manner.

It is a further object to provide a hair coloring applicator which prevents unnecessary mess during a hair treatment procedure.

It is still a further object to provide hair coloring applicator which is durable and able to withstand chemical contact.

It is a yet further object to provide a hair coloring applicator that operationally integrates a plurality of tools while facilitating manipulation of the tool as the technician holds the tool in a single hand while successively employing different tools and manually repositions the applicator with the fingers of the same hand.

To achieve these and other objects, a hair coloring applicator formed as a unitary, monolithic structure having an applicator portion, an intermediate portion and a pick portion is provided. The applicator portion is provided with a spoon for scooping hair coloring materials and a rounded head for spreading the material into the hair. One side of the applicator portion is provided with a serrated edge with ridges for lightly scratching the hair shaft to enable even distribution of the hair coloring materials. The other side of the applicator portion is thicker and provides a comb having a plurality of teeth which aid in spreading the materials and detangling the hair. The intermediate portion connects to one end of the applicator portion and includes a handle and guard portions on both sides of the handle. The pick portion extends in a tapered manner from one end of the intermediate portion and serves as an implement enabling the user to section and weave hair during a hair coloring procedure.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 1 illustrates a side view of a hair coloring applicator constructed according to the principles of the present invention;

FIG. 4. is a cross-sectional view taken along sectional line 4 in FIG. 1;

FIG. 5. is a cross-sectional view taken along sectional line 5 in FIG. 1;

FIG. 6. is a cross-sectional view taken along sectional line 6 in FIG. 1;

FIG. 7. is a cross-sectional view taken along sectional line 7 in FIG. 1; and

DETAILED DESCRIPTION OF THE PREFERRED EMBODIMENTS

Figure 2:
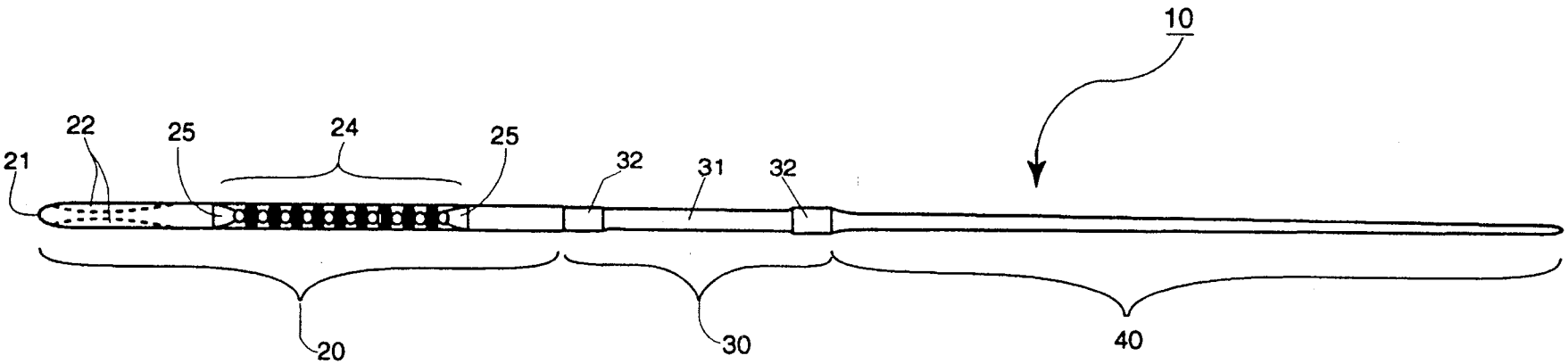
FIG. 2 illustrates a top view of a first side of the coloring applicator constructed according to the principles of the present invention.

Referring now to the drawings and particularly to FIG. 1, a side view of a hair coloring applicator 10 constructed according to the principles of the present invention is illustrated. In FIG. 1, hair coloring applicator 10 having an elongated shape is comprised of an applicator portion 20, an intermediate portion 30 providing a manually grippable user handle, and a pick portion 40.

Applicator portion 20 has a rounded head 21 with a spoon 22 formed in either one or both surfaces of one end, while the other end of applicator portion 20 is connected directly to intermediate portion 30. Spoon 22 is used to pick up hair coloring materials, such as a powdered bleach mixture or cream color. Rounded head 21, which resembles the end of a small spatula, is then used to apply and spread the hair color. The shape and size of rounded head 21, which can be contrasted with the bulkiness of conventional brushes, allows the user to apply and spread the hair coloring as close as possible to the hair roots. On one side of applicator portion 20, a serrated edge 23 having a length substantially co-extensive with the length of applicator portion 20 is provided. Serrated edge 23 provides ridges which arc designed to lightly scratch the hair shaft to enable a better and more even distribution of the chemicals. The side of applicator portion 20 opposite serrated edge 23 is thicker and provides a comb 24 having a plurality of chemically resistant teeth 25 to aid in spreading the chemicals and detangling the hair.

Intermediate portion 30 connects to the end of applicator portion 20 opposite rounded head 21 and includes a centrally positioned handle 31 of a suitable size and shape and guard portions 32 positioned on both sides of handle 31. In a preferred embodiment, all edges of intermediate portion 30 are rounded and smooth to provide a comfortable grip for the user. Handle 31 is arcuately curved outwardly from its center with increasing thickness towards guards 32, to enable a technician to easily reposition the applicator with the fingers of one hand, thereby allowing the technician to use one hand to manipulate the applicator and to successively bring pick 40, comb 24, spoon 22 and serrated edge 23 to bear upon the hair of a client without either touching the applicator with the other hand or without setting the applicator down. Guards 32 hinder solution from comb 24 from migrating onto handle 31, and solution that may have reached handle 31 as from the technician's fingers, from migrating past the rightmost guard 32 onto the shaft of pick 40. The control provided by guards 32 advantageously contributes to the neatness and precision of coloring.

The width and length of a shank 18 extends between the distal end occupied between spoon 22 and guard 32, with comb 24 extending laterally outwardly from one edge of shank 18 and the teeth of a serrated second edge of shank 18 being separated by the broad width of shank 18 from comb 24.

Pick portion 40 extends in a tapered manner from one end of intermediate portion 30 and provides a means for the user to section and weave hair for highlighting and streaking effects. Hair coloring applicator 10 is preferably composed of a hard flexible material, such as rubber or plastic, that has great resistance to alkalies and chemicals. Also, a smooth, mirror-like finishing can be provided over the entire exterior portion of applicator 10 to eliminate any sharp edges.

Referring now to FIG. 2, a top view of a first side of hair coloring applicator 10 constructed according to the principles of the present invention is illustrated. In particular, FIG. 2 shows the top view of the side of applicator 10 having comb 24 with a plurality of essentially parallel tines forming teeth 25. As shown, spoon 22 for can be provided on both surfaces of applicator portion 20.

Figure 3:
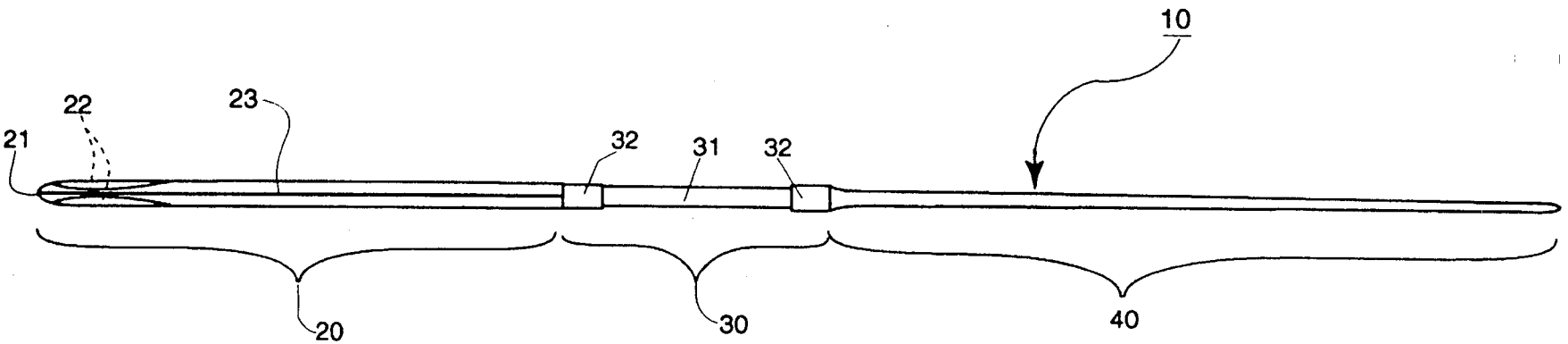
FIG. 3 illustrates a top view of a second side of the hair coloring applicator constructed according to the principles of the present invention.
Figure 8:
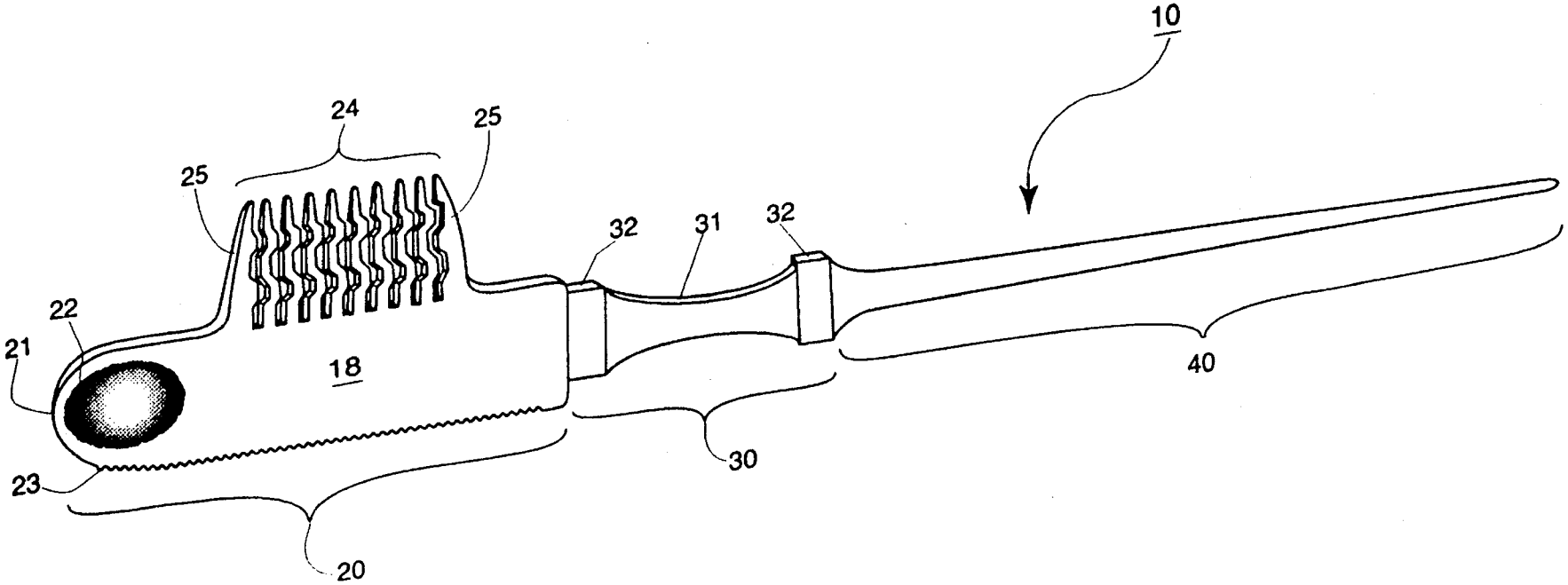
FIG. 8. is a perspective view of one embodiment constructed according to the principles of the present invention.

Referring to FIG. 3 in conjunction with cross-sectional views provided by FIGS. 4, 5, 6 and 7, and the perspective view of FIG. 8, it may be seen that a second side of the hair coloring applicator 10 provides serrated edge 23. It is again noted that this side of applicator 10 provides that serrated edge 23 be narrower in cross-sectional thickness than the side shown in FIG. 2, thereby ensuring that serrated edge 23 has a width necessary to lightly and effectively scratch the hair shaft for improved absorption of the hair coloring materials.

Referring now to FIGS. 1 through 8, the method of use of the hair coloring applicator constructed according to the principles of the present invention will be described. First, the user grasps handle 31, picks up hair using pick portion 40 and places the hair on hair coloring foil. The hair is sectioned and woven with pick portion 40 to enable highlighting and streaking. Comb 24 then can be used to untangle hair on the foil. Next, hair coloring material is scooped with spoon 22 and applied to the hair. Then, the hair coloring material is spread into the hair using serrated edge 23 which enhances absorption of the material and ensures an even application of the material throughout the hair. Accordingly, the hair coloring applicator 10 of the present invention advantageously provides the user with a single unitary tool for hair coloring which can replace the multiple tools that are typically required.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An applicator, comprising:

an elongated member having first and second longitudinally opposite end sections separated by an intermediate section, and a longitudinal axis extending through said first and said second end sections;

said intermediate section terminated by a guard interposed between said first end section and said second end section;

said first end section providing a cross-sectional dimension extending orthogonally to said longitudinal axis, said cross-sectional dimension exhibiting a continuous taper extending from a first proximal end adjacent to said intermediate section to a first distal end terminating in a point with said taper providing a continuously decreasing cross-section to said first end section along a length of said first end section from a first proximal end adjacent to said guard to a point terminating a first distal end of said first end section, said length being greater than a greatest value of said cross-sectional dimension;

said second end section having first and second opposite major surfaces extending between said intermediate section and a second distal end terminating said second end section, said first and said second major surfaces being bounded on transversely opposite sides of said longitudinal axis by first and second edges;

a blind receptacle open to and formed within said second distal end;

said first edge being serrated; and said second edge bearing a plurality of tines forming a comb.

2. The applicator of claim 1, comprising said first end section, said intermediate section and said second end section being a unitary, monolithic structure.

3. The applicator of claim 1, comprising said second distal end being rounded by a third edge curving between said first edge and said second edge.

4. The applicator of claim 1, comprising a second receptacle formed within a second one of said major surfaces.

5. The applicator of claim 1, comprising:

said first end section, said second end section and said intermediate section being made of a flexible material; and said first end section, said second end section and said intermediate section being a unitary and monolithic structure.

6. An applicator comprising:

an elongated member having first and second longitudinally opposite end sections separated by an intermediated section, and a longitudinal axis extending through said first and said second end sections;

said intermediate section terminated by a guard interposed between said first end section and said second end section;

said first end section providing a cross-sectional dimension extending orthogonally to said longitudinal axis, said cross-sectional dimension exhibiting a continuous taper extending from a first proximal end adjacent to said intermediate section to a first distal end terminating in a point with said taper providing a continuously decreasing cross-section to said first end section along a length of said first end section from a first proximal end adjacent to said guard to a point terminating a first distal end of said first end section, said length being magnitude greater than a greatest value of said cross-sectional dimension;

said second end section having first and second opposite major surfaces extending between said intermediate section and a second distal end terminating said second end section, said first and said second major surfaces being bounded on transversely opposite sides of said longitudinal axis by first and second edges;

an open receptacle formed within said second distal end, said receptacle defining a spoon with a bowl of said spoon forming a depression within said second distal end;

said first edge being serrated; and said second edge bearing a plurality of tines forming a comb.

7. An applicator, comprising:

a spoon;

a handle;

a shank extending between and connecting said spoon to a first end of said handle;

a pick connected to a second end of said handle;

said handle, shank and pick being aligned in tandem along a longitudinal axis;

a guard separating said handle from said pick;

a first edge of said shank having a greater thickness terminated by a plurality of tines extending transversely outwardly from said first edge and forming a comb;

a second edge of said shank having a second and lesser thickness, being serrated; and said spoon having an outer lip curving between said first edge and said second edge.

8. The applicator of claim 7, comprising said shank having opposite major surfaces extending between said spoon and said handle, with said first and second edges bordering said major surfaces.

9. The applicator of claim 7, comprised of:

said spoon, said handle, said shank and said pick being made of a flexible material; and said spoon, said handle, said shank and said pick comprising an unitary and monolithic structure.

10. The applicator of claim 7, comprising said first edge and said second edge being separated by a width of said shank.

11. The applicator of claim 7, comprising:

said outer lip terminating one end of said applicator while extending between said first edge and said second edge; and said first edge being laterally opposite from said second edge and being separated by a width of said shank from said second edge.

12. The applicator of claim 7, comprising:

said outer lip terminating a distal end of said applicator while extending between said first edge and said second edge; and said comb being spaced-apart from said second edge by a width of said shank.

13. An applicator, comprising:

a spoon;

a handle;

a shank extending between and connecting said spoon to a first end of said handle;

said spoon handle, and shank being aligned in tandem along a longitudinal axis;

a guard terminating said handle;

a first edge of said shank having a greater thickness terminated by a plurality of tines extending transversely outwardly from said first edge and forming a comb;

a second edge of said shank having a second and lesser thickness, being serrated; and said spoon having an outer lip extending in a curved arc between said first edge and said second edge.

14. The applicator of claim 13, comprising said shank having opposite major surfaces extending between said spoon and said handle, with said first and second edges bordering said major surfaces.

15. The applicator of claim 13, comprised of:

said spoon, said handle and said shank being made of a flexible material; and said spoon, said handle and said shank comprising an unitary and monolithic structure.

16. The applicator of claim 13, comprising a pick extending from said guard.

17. The applicator of claim 13, comprising:

a plane bisecting said handle, shank, guard, first edge, second edge and outer lip.

18. The applicator of claim 14, comprising:

a plane bisecting said handle, shank, guard, first edge, second edge and outer lip.

19. The applicator of claim 15, comprising:

a plane bisecting said handle, shank, guard, first edge, second edge and outer lip.

20. The applicator of claim 16, comprising:

a plane bisecting said handle, shank, guard, first edge, second edge, and outer lip and said pick.

21. An applicator, comprising:

an elongate member having first and second longitudinally opposite end sections separated by an intermediate section, and a longitudinal axis extending through said first and said second end sections;

said intermediate section being separated from said first and second end sections by guards, said guards extending continuously around said applicator at a greater radial distance from said longitudinal axis than said intermediate section;

an open receptacle formed within a distal portion terminating one of said end sections, said open receptacle having an outer lip curved to terminate said distal portion;

a serrated edge situated along an outermost periphery of said applicator;

a comb formed transversely opposite to said serrated edge, said comb comprising a plurality of tines extending outwardly away from said one of said end sections and away from said longitudinal axis; and a pick terminating a second of said end sections.

* * * * *